US005480149A

United States Patent [19]

Trudeau

[11] Patent Number: 5,480,149

[45] Date of Patent: Jan. 2, 1996

[54] FLIPPER FEEDER RAMP

[75] Inventor: John Trudeau, Bolingbrook, Ill.

[73] Assignee: Williams Electronics Games, Inc., Chicago, Ill.

[21] Appl. No.: 299,731

[22] Filed: Sep. 1, 1994

[51] Int. Cl.[6] ..... A63F 7/30

[52] U.S. Cl. ..... 273/118 R; 273/118 A; 273/121 R; 273/121 A

[58] Field of Search ..... 273/118, 119, 273/121, 127, 129

[56] References Cited

U.S. PATENT DOCUMENTS 3,582,074 6/1971 Menotti ..... 273/121 A X 4,606,545 8/1986 Ritchie ..... 273/121 A 5,149,094 9/1992 Tastad ..... 273/119 A X

*Primary Examiner*—Raleigh W. Chiu

*Attorney, Agent, or Firm*—Rockey, Rifkin and Ryther

[57] ABSTRACT

The invention consists of a pair of flippers located adjacent the bottom of the playfield. A pair of ramps or other similar ball conveyors are provided where each ramp delivers the ball directly to one of the two flippers. A third ramp is provided that connects the first ramp with the second ramp such that a ball riding on either the first or second ramps can bypass the flipper associated with that ramp and be conveyed via the third ramp to the opposite flipper. Automatically operated gates control the access of the ball to the third ramp such that the game can control to which flipper the ball is delivered.

17 Claims, 2 Drawing Sheets

FLIPPER FEEDER RAMP

BACKGROUND OF THE INVENTION

The invention relates, generally, to pinball games and, more particularly, to a ramp for feeding the flippers of such games.

Pinball games typically consists of an inclined playfield supporting a rolling ball, a plurality of play features and a pair of player operated flippers. The player controls the flippers to shoot the ball at selected play features thereby to control play of the game and score points.

In the typical arrangement, the ball is delivered to the flippers in one of two ways. First, the ball can roll down the playfield directly to the flippers. Second, the ball can be shot onto a ramp which conveys the ball to a position adjacent to a flipper associated with the ramp. The ball is then dropped onto the playfield where it will roll to that flipper. Typically, one ramp is associated with each flipper such that when a ball traverses one of the ramps it is delivered to the flipper associated with that ramp.

While such an arrangement has proved successful, it is limited in that the completion of a ramp shot by the player will always result in the ball being delivered to the same flipper. Thus, the flipper to which the ball is delivered is controlled entirely by the player.

A ball delivery system for feeding flippers that provides more complex play and can be game controlled is desired.

SUMMARY OF THE INVENTION

The invention consists of a pair of flippers located adjacent the bottom of the playfield. A pair of ramps or other similar ball conveyors are provided where each ramp delivers the ball directly to one of the two flippers. A third ramp is provided that connects the first ramp with the second ramp such that a ball riding on either the first or second ramps can bypass the flipper associated with that ramp and be conveyed via the third ramp to the opposite flipper. Automatically operated gates control the access of the ball to the third ramp such that the game can control to which flipper the ball is delivered.

DETAILED DESCRIPTION OF THE INVENTION

Figure 1:
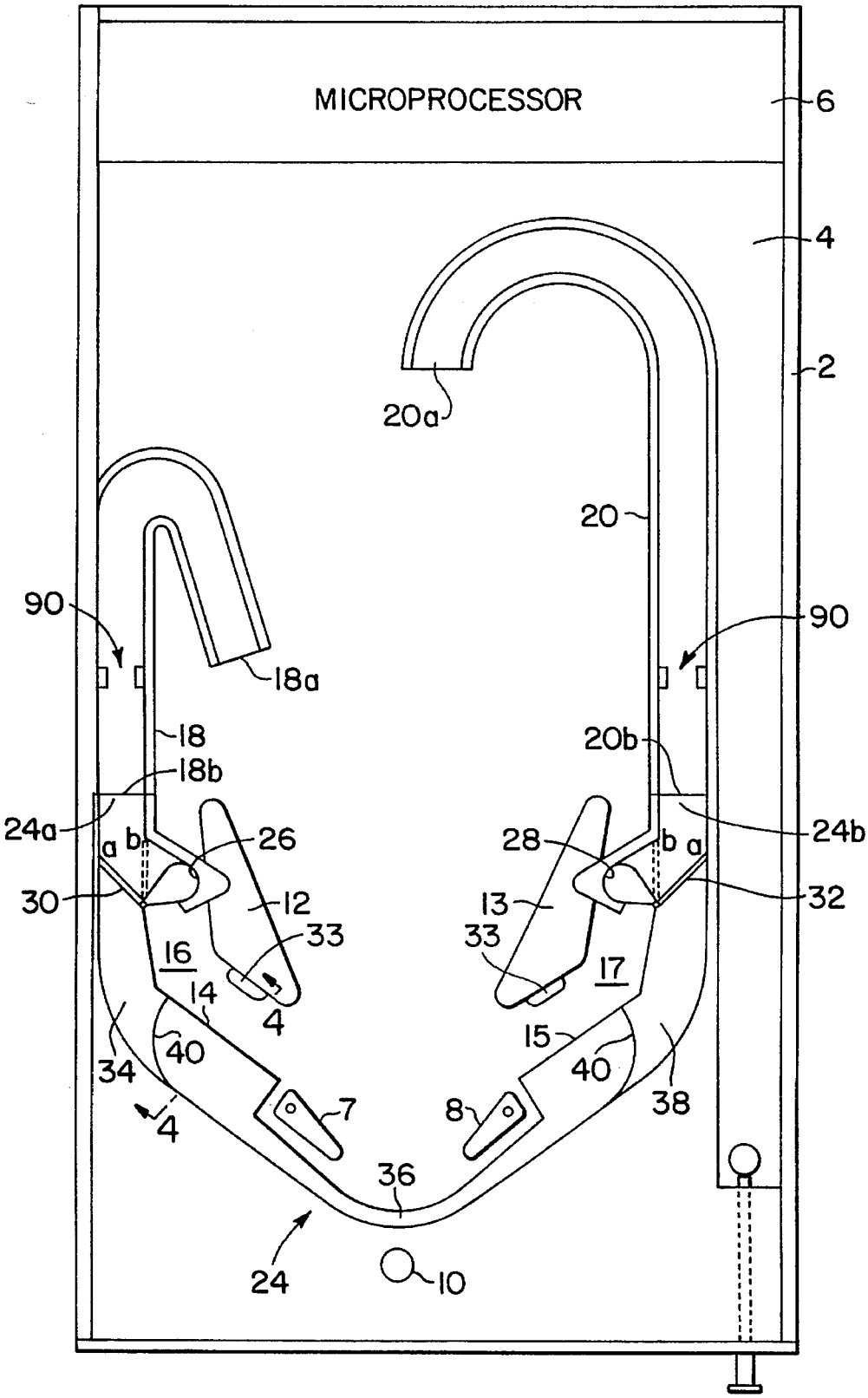
FIG. 1 is a top view of a pinball game with the ramp of the invention.

Referring more particularly to FIG. 1, the pinball game of the invention consists of a game cabinet 2 supporting an inclined playfield 4, a back box 6 and a plurality of play features (not shown). The back box 6 typically houses the microprocessor control, related electronics, video and audio displays, art work and the like.

Located on playfield 4 are a pair of player operated flippers 7 and 8 located generally in front of out hole 10 and spaced to allow passage of a ball therebetween. Associated with each flipper is a substantially triangular shaped sling shot bumper 12 and 13. Located behind each of bumpers 12 and 13 are walls 14 and 15. Walls 14 and 15 and bumpers 12 and 13 are arranged to define ball lanes 16 and 17 therebetween where a ball entering the ball lanes will roll under gravity and be delivered to the flippers 7 and 8, respectively.

Disposed above playfield 4 are a pair of ramps 18 and 20. In the illustrated embodiment, ramps 18 and 20 have inlets 18*a* and 20*a*, respectively, that are substantially flush with playfield 4 such that a ball can be propelled onto the ramps. From their inlets the ramps 18 and 20 gradually elevate. The ramps terminate at outlets 18*b* and 20*b*, respectively. While a particular configuration of ramps 18 and 20 has been illustrated, it will be appreciated that the ramps could have any configuration and can be accessed in any manner and include other play features along the length thereof. Moreover, the ball can be delivered to the flippers by a mechanism other than a ramp.

Interconnecting the outlets 18*b* and 20*b* of ramps 18 and 20 is the flipper feeder ramp 24 of the invention. Feeder ramp 24 can be of molded plastic or other similar construction and includes a first end 24*a* that communicates with ramp 18 and a second end 24*b* that communicates with ramp 20. Ramp 24 is generally U-shaped and extends around the outside of flippers 7 and 8.

The specific structure and operation of ramp 24 will now be described. Ramp 24 includes drop holes 26 and 28 located adjacent ends 24*a* and 24*b*. Drop holes 26 and 28 are disposed over lanes 16 and 17, respectively. Gates 30 and 32 are arranged adjacent holes 26 and 28 and are movable by a solenoid or other driver between solid line position a and dotted line position b. When in position a the gates 30 and 32 direct the ball to drop holes 26 and 28, respectively. When in position b, the gates 30 and 32 allow the ball to pass drop holes 26 and 28 and traverse ramp 24.

Figure 2:
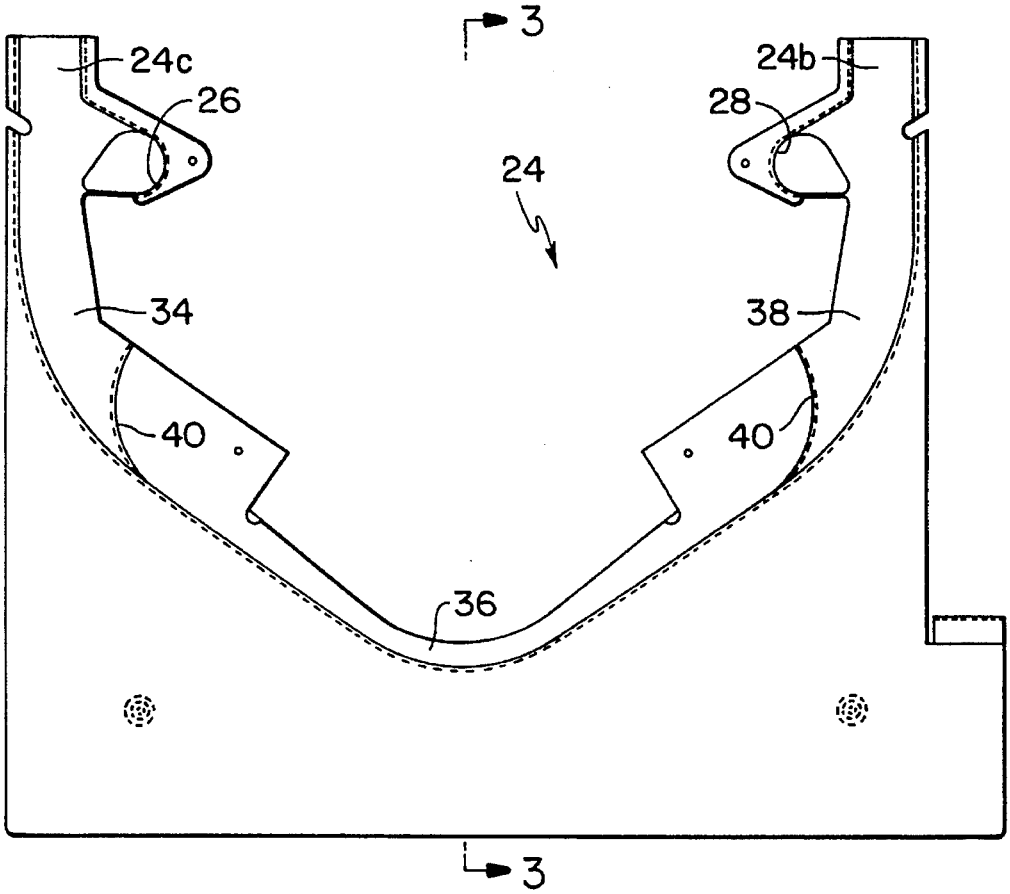
FIG. 2 is a more detailed view of the ramp of the invention.
Figure 3:
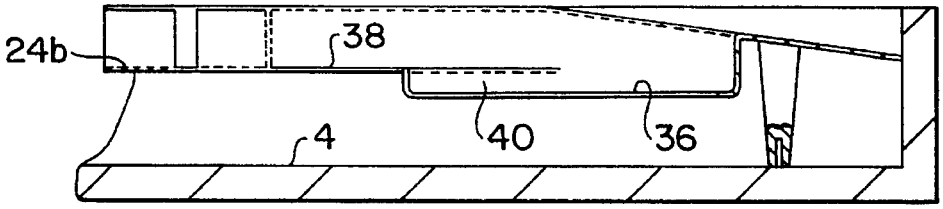
FIG. 3 is a section view taken along line 3—3 of FIG. 2.

The ramp 24 has three distinct ball supporting surfaces 34, 36 and 38. Surfaces 34 and 38 are arranged at the same elevation while surface 36 is disposed below and between surfaces 34 and 38. Surface 36 is connected to surfaces 34 and 38 by vertical walls 40. As best shown in FIG. 2, walls 40 join surface 36 with surfaces 34 and 38 along a curved profile. Surface 36 is made narrow in the area between flippers 7 and 8 to prevent a ball that inadvertently lands on the ramp from becoming stranded along section 36. If the ball does not have sufficient speed to traverse the ramp, it simply falls back onto the playfield.

Operation of the play feature of the invention will now be described with specific reference to FIG. 1. For purposes of explanation assume that the pinball game starts with both gates in position a, (however, one or both of the gates could be in position b to start the game, if desired). With the gates in position a, a ball projected onto ramp 18 will enter ramp 24 at end 24*a* and will be diverted by gate 30 into hole 26. The ball will drop through hole 26 into lane 16 and will be delivered to flipper 7. Likewise, a ball shot onto ramp 20 will enter ramp 24 at end 24*b* and will be diverted into hole 28 by gate 32 where the ball will drop into lane 17 and be delivered to flipper 8.

At various times during play of the game, the game microprocessor will open one or both of the gates 30 and 32. The opening of the gates can be in response to the player making a selected shot, achieving a selected score or other similar criteria or the gates can be opened and closed randomly.

Figure 4:
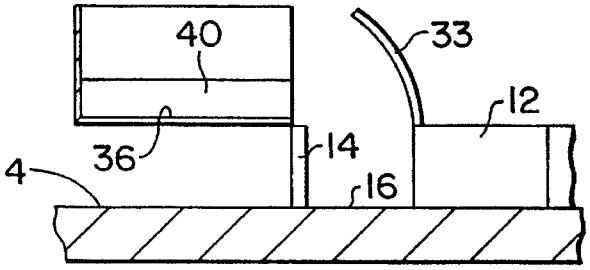
FIG. 4 is a section view taken along line 4—4 of FIG. 1.

When gate 30 is open, a ball projected onto ramp 18 will bypass hole 26 and travel over surface 34 until it drops onto surface 36. It will traverse surface 36 and move from the left side of the playfield to the right side, as viewed in FIG. 1. When the ball reaches the end of surface 36, it will contact curved vertical wall 40 and be diverted off of ramp 24 and into lane 17 where it will drain onto flipper 8. The same sequence of events, in the opposite direction, will occur when a ball enters ramp 24 from ramp 20 and gate 32 is open. Ball guides 33 are mounted on sling shot bumpers 12 opposite vertical walls 40 to guide the balls into lanes 16 and 17 as best shown in FIG. 4.

In one embodiment, a sensor 90 is located on one or both of ramps 18 or 20. The sensor 90 can consist of an optical switch having a light emitter and detector that produces a signal when it detects a ball rolling on the ramp. Upon receipt of this signal, the game microprocessor will have the option to open the gate associated with the ramp on which the ball is travelling to allow the ball to traverse ramp 24 and be delivered to the opposite flipper. In this manner, the game can control to which flipper the ball is delivered and control the difficulty of shots and vary play of the game.

While the invention has been described in some detail with reference to the figures, it will be appreciated that numerous changes in the details and construction of the device can be made without departing from the spirit and scope of the invention.

What is claimed is:

1. A play feature for a pinball game having an inclined playfield supporting a rolling ball, comprising:

a) a first flipper;

b) a second flipper;

c) a ramp for delivering a ball between the first and second flippers;

d) first means for delivering the ball to a first end of the ramp;

e) second means for delivering the ball to a second end of the ramp; and f) means for controlling access to said ramp from said first and second means for delivering.

2. The play feature according to claim 1, wherein the ramp includes a third means for delivering the ball to the first flipper and a fourth means for delivering the ball to the second flipper.

3. The play feature according to claim 1, wherein the third means and fourth means include drop holes.

4. The play feature according to claim 2, further including means for diverting a ball from the ramp to said third and fourth means.

5. The play feature according to claim 4, wherein said means for diverting includes a gate associated with the third and fourth means.

6. The play feature according to claim 1, wherein said ramp includes means for diverting the ball from the ramp to the first and second flippers.

7. The play feature according to claim 6, wherein said means for diverting includes a vertical wall on said ramp.

8. A play feature for a pinball game having an inclined playfield supporting a rolling ball comprising:

a) a first flipper;

b) a second flipper;

c) first means for delivering the ball to the first flipper;

d) second means for delivering the ball to the second flipper;

e) means for selectively delivering the ball from the first means to the second flipper and from the second means to the first flipper; and f) means for controlling the means for selectively delivering thereby to control the flipper to which the ball is delivered.

9. The play feature according to claim 8, wherein the first and second means include ramps.

10. The play feature according to claim 8, wherein the first and second means include drop holes.

11. The play feature according to claim 8, wherein the means for selectively delivering includes gates.

12. The play feature according to claim 11, wherein said means for controlling includes a microprocessor for controlling the positions of the gates.

13. The play feature according to claim 12, a sensor for detecting the approach of a ball toward said first and second means, said microprocessor controlling the position of the gates in response to the detection of a ball.

14. A play feature for a pinball game having an inclined playfield supporting a rolling ball, said play feature comprising:

(a) first and second player-controlled flippers to be mounted on said playfield;

(b) ramp means for receiving a ball and for selectively delivering said ball to either of said flippers; and (c) control means for selecting to which flipper said ball is delivered.

15. The play feature of claim 14 wherein said ramp means includes a ball positioned behind said flippers for delivering a ball to said first or second flipper.

16. The play feature of claim 15 wherein said control means includes gate means associated with each of said first and second flippers.

17. The play feature of claim 16 wherein said gate means includes a gate and a drop hole whereby in a first position, the gate delivers a ball through said drop hole to its associated flipper and in a second position, the gate delivers a ball to the other of said flippers via said ball ramp.

* * * * *